United States Patent [19]

Yamada

[11] Patent Number: 4,474,039

[45] Date of Patent: Oct. 2, 1984

[54] LIQUID FLOW TYPE FABRIC TREATING APPARATUS

[75] Inventor: Kazuo Yamada, Aichi, Japan

[73] Assignee: Nippon Dyeing Machine Mfg. Co., Ltd., Aichi, Japan

[21] Appl. No.: 410,233

[22] Filed: Aug. 23, 1982

[30] Foreign Application Priority Data

Jan. 25, 1982 [JP] Japan ..... 57-9726
Feb. 23, 1982 [JP] Japan ..... 57-24472[U]

[51] Int. Cl.[3] ..... D06B 3/24; D06B 3/28
[52] U.S. Cl. ..... 68/177; 68/184
[58] Field of Search ..... 68/177, 178, 184

[56] References Cited

U.S. PATENT DOCUMENTS

| | | | |
|---|---|---|---|
| 3,659,438 | 5/1972 | Chiba et al. | 68/177 |
| 3,924,424 | 12/1975 | Watanabe et al. | 68/177 |
| 3,949,580 | 4/1976 | Trullas | 68/177 |
| 3,982,411 | 9/1976 | Kreitz | 68/177 |
| 4,020,658 | 5/1977 | Thies | 68/177 X |

*Primary Examiner*—Philip R. Coe

*Attorney, Agent, or Firm*—Martin A. Farber

[57] ABSTRACT

A liquid flow type fabric treating apparatus having an annular fabric transfer passage composed of a transfer pipe and a stagnant cell connected to the transfer pipe, a first treating liquid jetting portion and a second treating liquid jetting portion; and at least one circulation pump for forcibly supplying the treating liquid from the stagnant cell to the liquid jetting portions and to circulate the treating liquid. The transfer pipe is provided at the lower stage of the stagnant cell so that the shifting of the fabric is made smoothly. A ramp portion for raising the fabric is provided at the outlet portion of the stagnant cell. The upper end portion of the ramp portion constitutes an inlet/outlet for the fabric. A fabric guide pipe is detachably secured to the inlet/outlet to form the transfer passage after the feed of the fabric into and out of the apparatus. The circulation pump is provided in plural, so that the operation of the apparatus is switchable beween a mode in which only one of the pump operates and a mode in which the pumps operate in parallel with or series to each other.

3 Claims, 8 Drawing Figures

(PRIOR ART)

LIQUID FLOW TYPE FABRIC TREATING APPARATUS

BACKGROUND OF THE INVENTION

1. Field of the Invention

The present invention relates to a liquid flow type fabric treating apparatus.

2. Description of the Prior Art

In the known apparatus of this kind, the fabric to be treated is tracted by the force of the jet of a treating liquid and the mechanical force exerted by reels or the like. In order to obtain an optimum tracting force, it is necessary to suitably set the jet of liquid and the mechanical force each time the fabric to be treated is changed. An inadequate tracting force may cause a large difference between the peripheral speed of the reel and the running speed of the fabric, resulting in a large slip of the fabric on the reel. In such a case, the treating liquid impregnating the fabric, serving as a lubricant, is squeezed from the fabric to increase a tendency of damaging of the fabric surface. If the setting of the tracting force is quite inadequate, or if the pump fails to operate for any reason, the transfer of the fabric is made quite unsmooth, resulting in entanglement around the reel and requiring a suspension of operation of the whole apparatus for the recovery.

When the apparatus is operated at a high speed of, for example, 400 to 500 m/min. at an ultra-low bath ratio of between 1:5 and 1:8, the fabric cannot run stably due to a cavitation or a surging in the pump. In addition, the operation of the flow-rate adjusting bypass valve is extremely troublesome and difficult to conduct. Furthermore, the conventional apparatus often causes wasteful use of electric power depending on the kind, structure and the treating rate of the fabric. Furthermore, in the conventional apparatus, it is extremely difficult to obtain a balance between the running of the fabric and the rate of circulation of the treating liquid at the time of start of the high-speed operation. A complicated and troublesome operation of by-pass valve has been required for attaining such a balance. The result of the adjustment fluctuated depending on the person who operates the apparatus.

SUMMARY OF THE INVENTION

Accordingly, an object of the invention is to provide an apparatus in which the transfer of the fabric can be made stably without using any mechanical driving reel and in which the fabric to be treated is easily taken into and out of the apparatus, thereby to obviate the above-described problems of the prior art. The invention also aims at providing an apparatus which can perform a stable transfer of the fabric even at a high speed and at an extremely low bathing ratio.

To these ends, according to the invention, there is provided a liquid flow type fabric treating apparatus comprising: an annular fabric processing circuit composed of a transfer pipe in which the fabric to be treated is transferred in a straight form and linear manner and a stagnation cell connected to said transfer pipe and adapted to transfer the fabric to be treated in a winding form; a first treating liquid jetting portion provided at the upstream end of said transfer pipe; a fabric lifting ramp portion extending from a position below a liquid surface to a position thereabove formed at the outlet portion of said stagnant cell; a second treating liquid jetting portion formed at the upper end of the ramp portion; and a treating liuquid circulation pump adapted to supply the treating liquid from the stagnant cell to the first and second liquid jetting portions and to circulate the treating liquid.

According to another aspect of the invention, the fabric treating apparatus includes control means for controlling the jetted liquid.

According to still another aspect of the invention, at least two treating liquid circulation pumps are provided, one being a main pump while the other is an auxiliary pump, and the treating liquid circulation passage is so constructed that the pair of treating liquid circulation pumps constitutes a switchable treating liquid circulation circuit, in which one of the pumps is used singly, or both of the pumps are used simultaneously, to circulate the treating liquid.

According to a further aspect of the invention, the apparatus further comprises a fabric inlet-outlet formed on the upper end of the fabric lifting ramp and a fabric guide pipe detachably secured to the inlet/outlet and forming a part of the annular fabric transfer passage. When the fabric guide pipe is detached, the fabric transfer passage is cut and opened to communicate with the fabric transfer passage and, as the fabric guide pipe is attached, the conveyor passage is completed.

The above and other objects, features and advantages of the invention will become clear from the following description of the preferred embodiments taken in conjunction with the accompanying drawings.

DESCRIPTION OF THE PREFERRED EMBODIMENTS

Preferred embodiments of the invention will be described hereunder with reference to the accompanying drawings.

Figure 1:
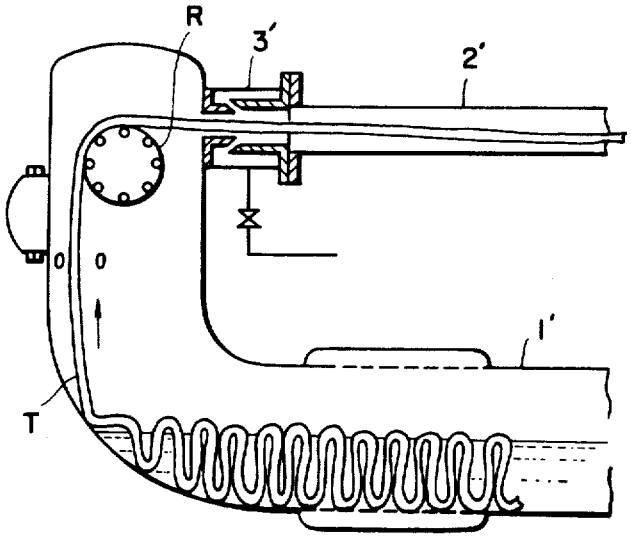
FIG. 1 is a schematic illustration of a part of a conventional dyeing apparatus of reel-drive liquid-flow type.

FIG. 1 schematically shows a part of a conventional dyeing apparatus of reel-drive and liquid-flow type. In this Figure, a reference numeral 1' denotes a stagnant cell, 2' denotes a fabric transfer pipe, 3' denotes a treating liquid jetting portion, R represents a fabric driving reel, and T represents a fabric to be treated.

Figure 2:
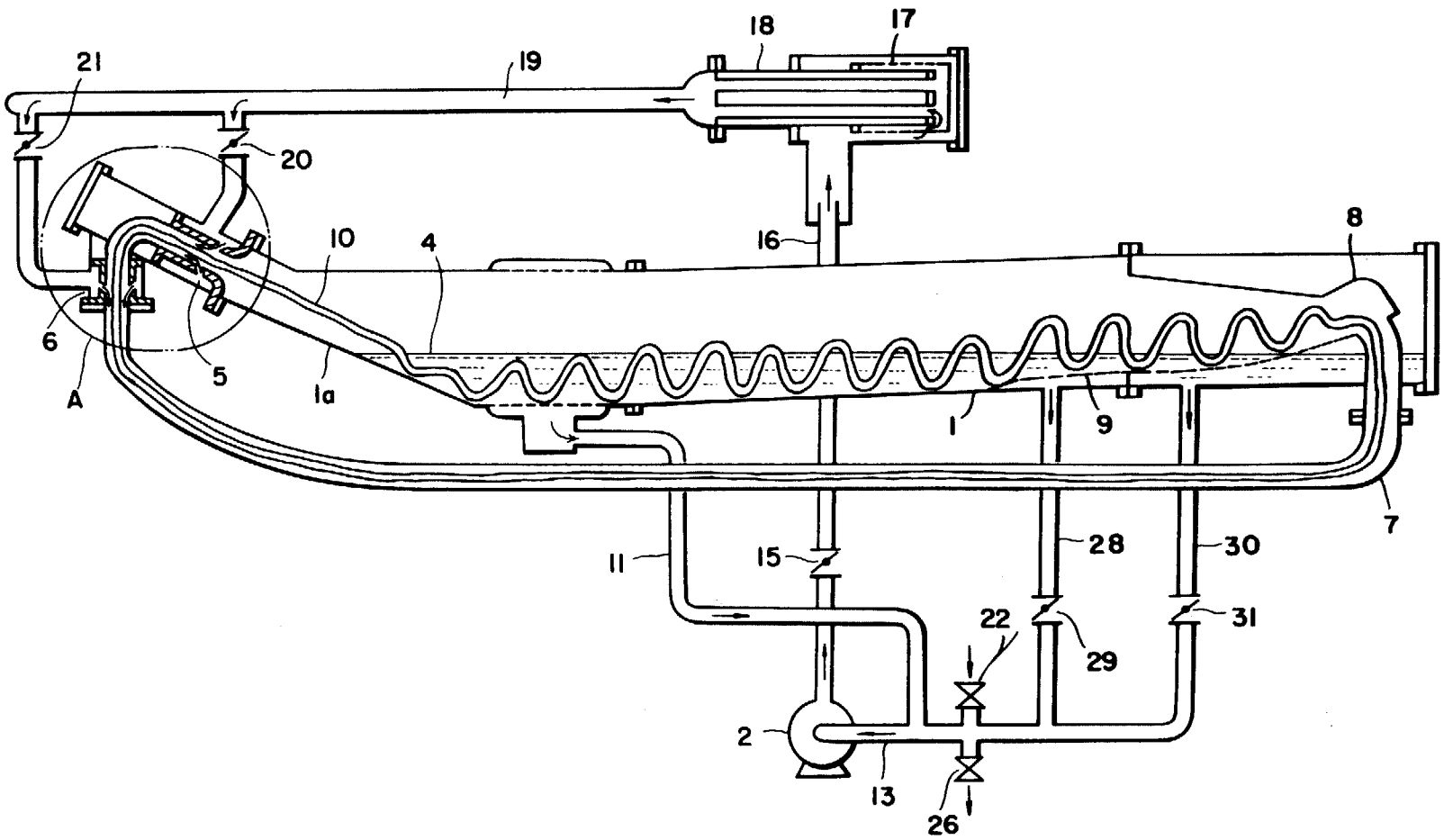
FIG. 2 is a schematic side elevational sectional view of a liquid flow-type fabric treating apparatus in accordance with an embodiment of the invention.

FIG. 2 is a sectional side elevational view of a fabric treating apparatus of liquid-flowing type in accordance with an embodiment of the present invention. In this Figure, a reference numeral 1 denotes a fabric stagnant cell, **1*a* denotes a fabric lifting ramp provided at the outlet portion of the stagnant cell extending from a position below the liquid level 4 of the treating liquid to a position thereabove, and 5 and 6 denote treating liquid jetting portions which are provided at the outlet portion of the upper stagnant cell and the inlet to the lower stage transfer pipe 7, i.e. the upstream end. Reference numerals 8 and 9 denote casing parts made of porous plates and adapted to permit the treating liquid to pass therethrough. A fabric 10 to be treated is mounted in an endless form. Reference numerals 11,28 and 30 denote treating liquid suction pipes, numerals 15,20,21,29 and 31 denote flow-rate regulating valves, and 13 denotes a suction pipe for the pump 2. The treating liquid coming out of the flow-rate regulating valve 15 is made to flow through a filter 17 past the discharge pipe 16 and is heated by a heat exchanger 18. A reference numeral 19 denotes an outlet pipe of the heat exchanger branched into branch pipes 20 and 21 which are connected to the liquid jetting portions 5 and 6 through flow-rate regulating valves to permit the adjustment of the liquid jetting pressures at respective jetting portions. A reference numeral 22 denotes a liquid supply valve, while 26** denotes a liquid discharge valve.

Figure 3:
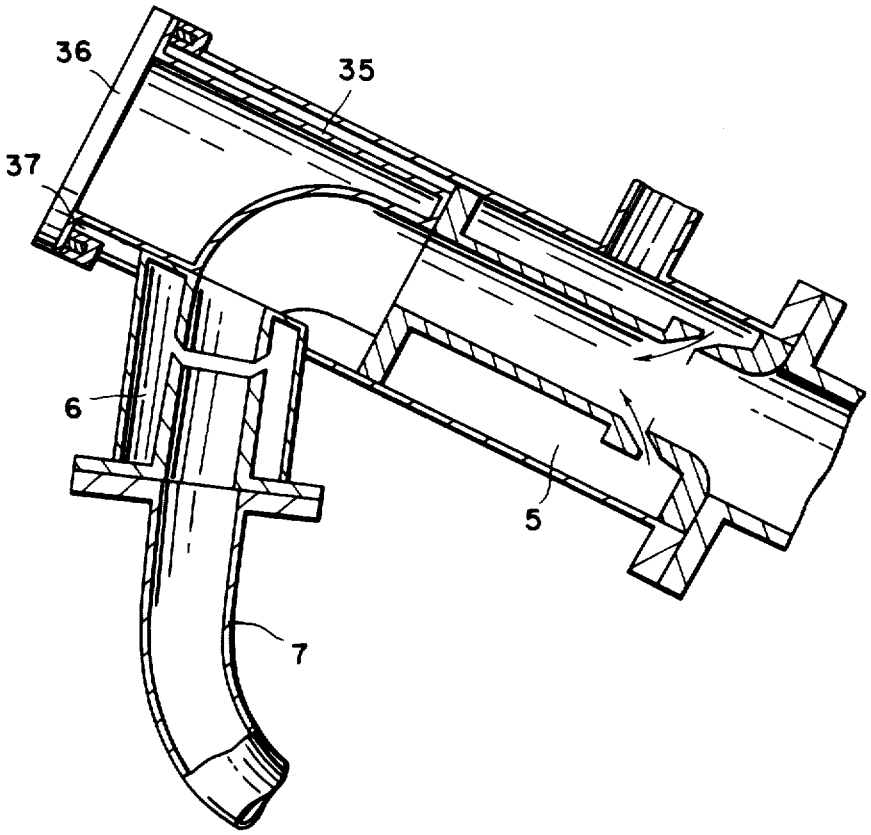
FIG. 3 shows the detail of the portion marked at A in FIG. 2, showing particularly a detachable guide pipe constituting a portion of the cloth transfer pipe.

FIG. 3 shows the detail of the portion marked at A in FIG. 2. A reference numeral 35 denotes a fabric guide pipe, 36 denotes a lid and 37 denotes a fabric inlet/outlet. For feeding the fabric into the dyeing apparatus, after opening the lid 36 and taking out the fabric guide pipe 35 to the outside of the dyeing cell, the treating liquid is forcibly supplied into the jetting portion 6 thereby to feed the leading end of the fabric into the transfer pipe 7. Then, as the leading end of the fabric reaches the cut open end of the transfer passage, the leading end of the fabric is connected to the trailing end of the same to complete an endless belt. Then, the guide pipe 35 is mounted to complete the fabric transfer passage, and then the lid 36 is closed to permit the start of the apparatus.

Figure 4:
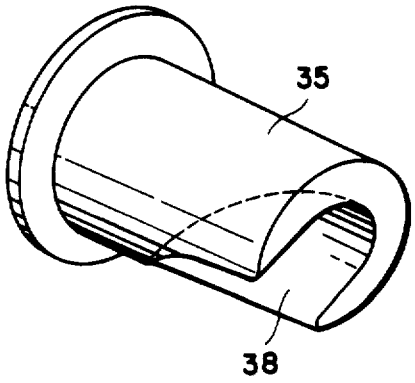
FIG. 4 is a perspective view of the guide pipe.

FIG. 4 is a perspective view of a guide pipe 35 shown in FIG. 3. The guide pipe 35 has a fabric guide groove 38 which constitutes a part of the fabric transfer passage. An explanation will be made hereunder as to another embodiment of the invention having a main liquid circulation pump and an auxiliary circulation pump, with specific reference to FIG. 5.

Figure 5:
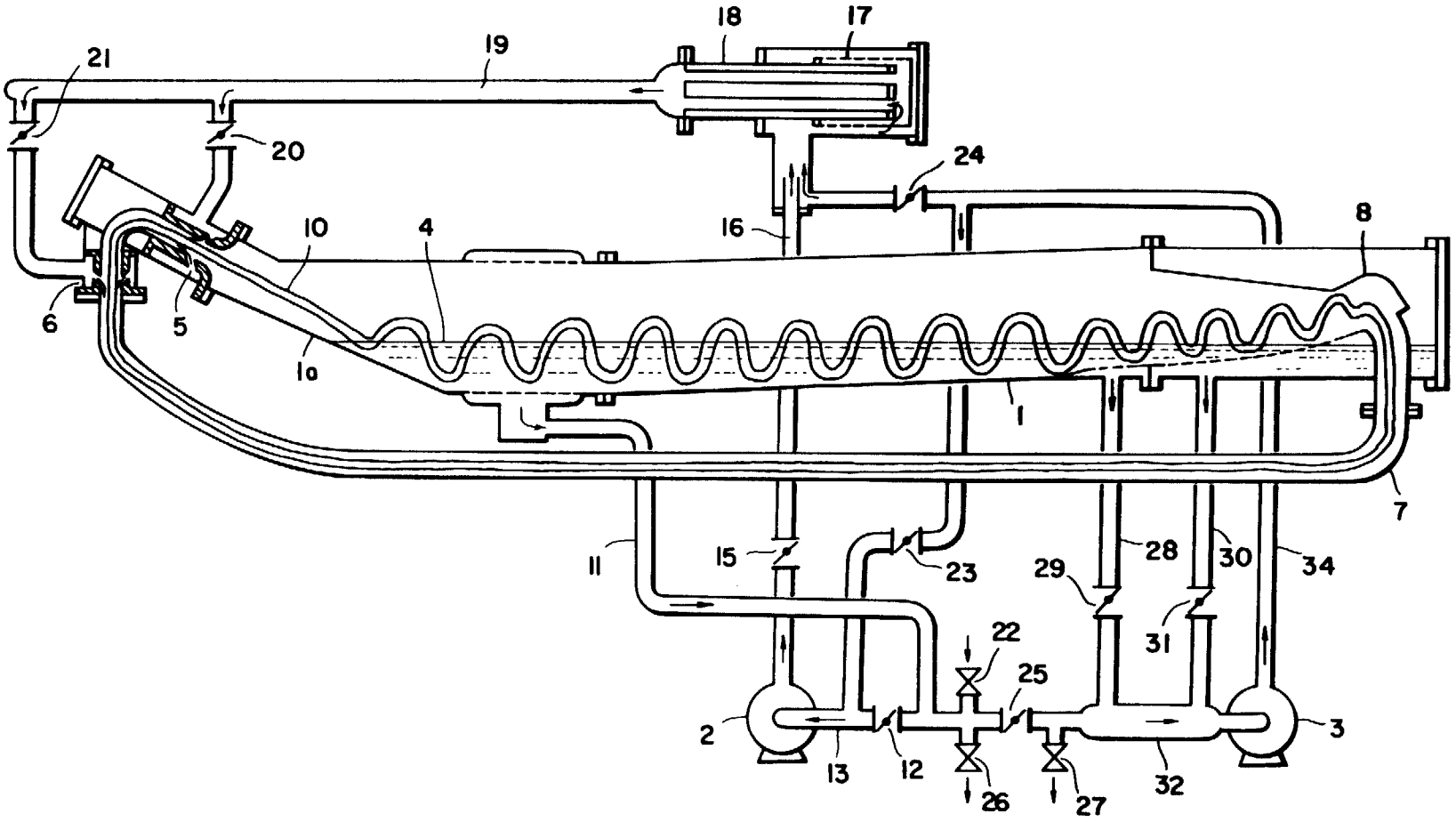
FIG. 5 is a sectional side elevational view of a liquid flow type fabric treating apparatus in accordance with the invention.

Referring to FIG. 5, a reference numeral 1 denotes a fabric stagnant cell, 1*a* denotes a fabric pulling ramp portion provided at the outlet portion of the stagnant cell extending from a position below the surface 4 of the liquid to be treated to a position thereabove and 5 and 6 denote treating liquid jetting portions which are provided at the outlet of the stagnant cell 1 of the upper stage and at the inlet of the transfer pipe 7 of the lower stage, respectively. Reference numerals 8 and 9 denote, respectively, casing parts constituted by porous plates adapted to permit a part of the treating liquid to flow therethrough. A reference numeral 10 denotes a fabric to be treated, mounted in an endless manner. Numerals 11,28 and 30 denote treating liquid suction pipes, while numerals 12,15,20,21,23,24,25, 29 and 31 denote flow-rate regulating valves. A suction pipe 13 of the main pump 2 branches into two pipes which are provided with flow-rate regulating valves 12 and 23, respectively. The treating liquid coming out of the flow-rate regulating valve 15 is made to flow through a filter 17 past a discharge pipe 16 and is heated up to a desired temperature by means of a heat exchanger 18. A heat exchanger outlet pipe 19 is branched into two pipes which lead to the treating liquid jetting portions 5 and 6 through respective flow-rate adjusting valves 20 and 21 to permit the adjustment of jetting pressures of the liquid in respective jetting portions 5 and 6. A reference numeral 22 designates a liquid feed valve, while numerals 26 and 27 denote liquid discharge valves. A reference numeral 32 designates a liquid suction manifold pipe for an auxiliary pump 3, while a numeral 34 denotes a discharge pipe of the auxiliary pump 3. The discharge pipe 34 is adapted to be connected to the heat exchanger through the flow-rate regulating valve 24 via the filter 17 (in parallel running of pump) or to the suction side of the main pump 2 through the flow-rate regulating valve 23 (in series running of pumps).

Figure 6:
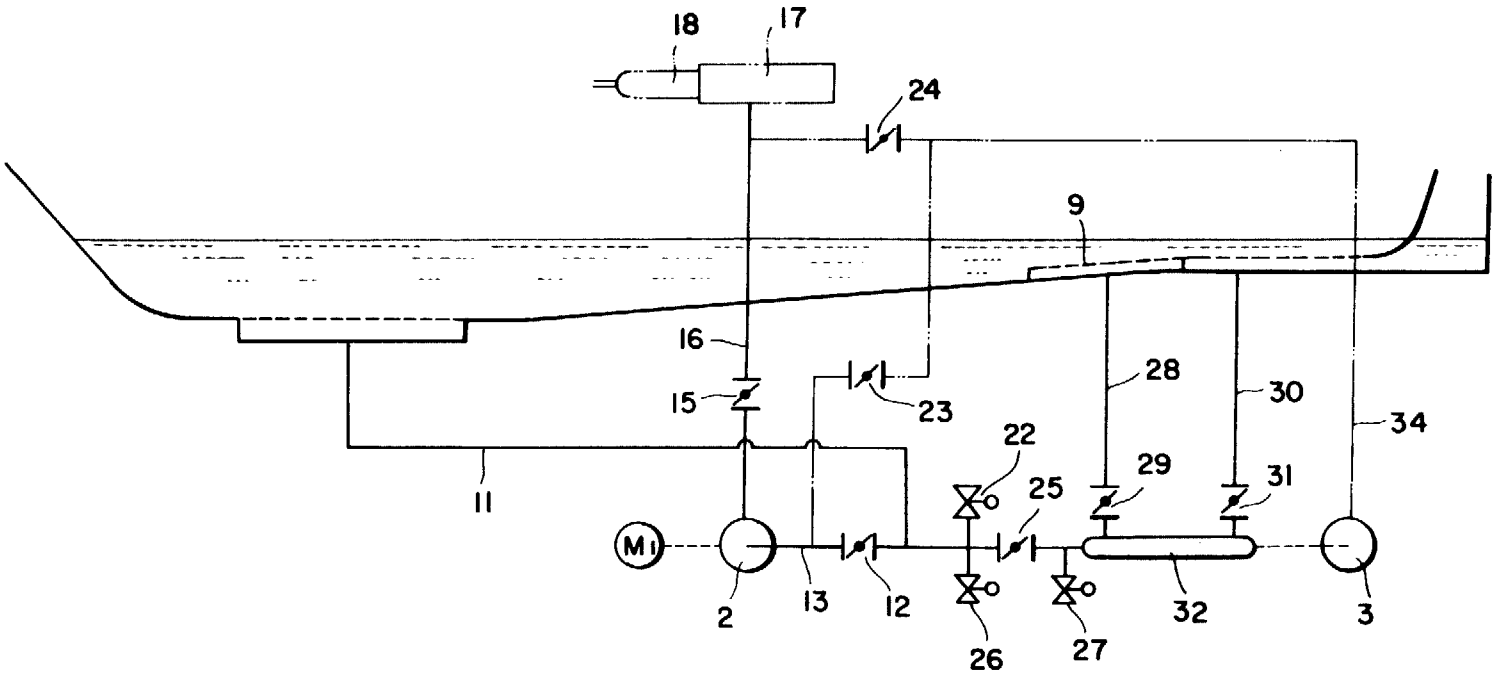
FIGS. 6, 7 and 8 are schematic illustrations of various embodiments of the invention.
Figure 7:
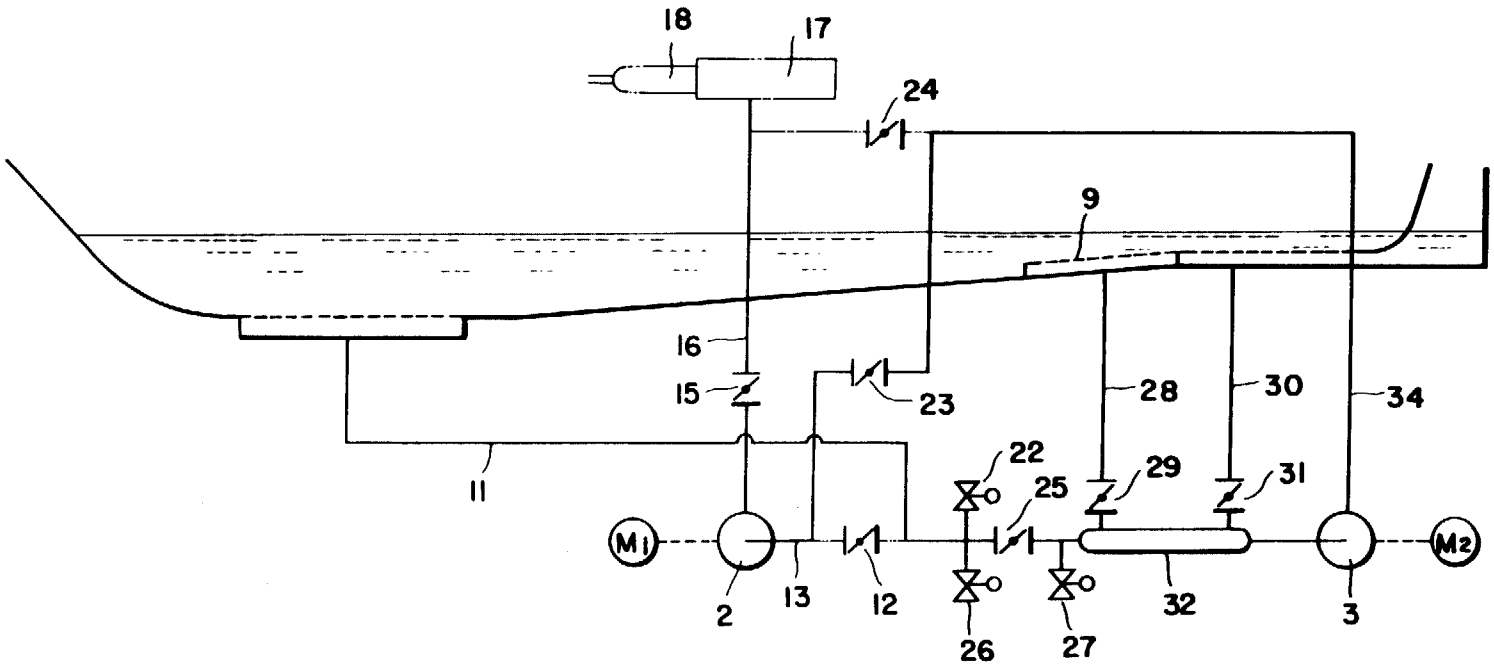
Figure 8:
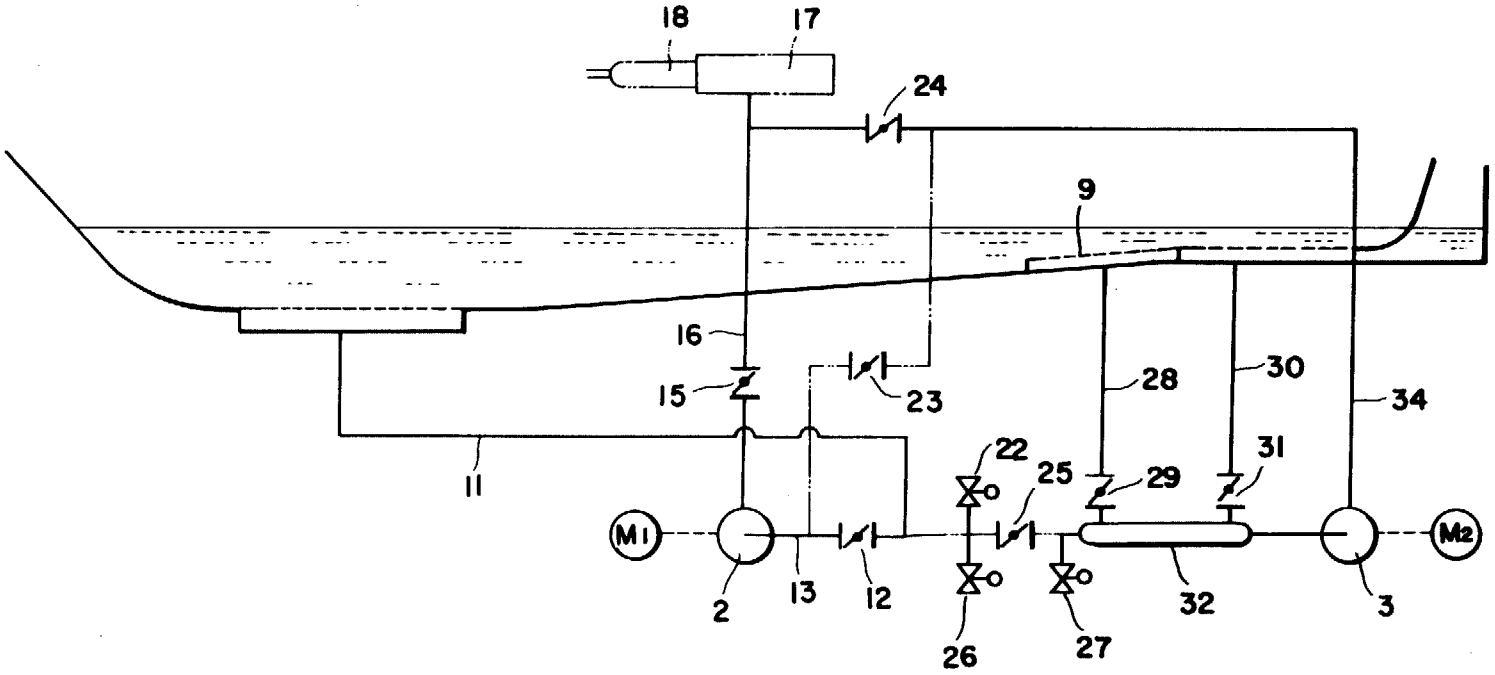

The arrangements shown in FIGS. 6,7 and 8 are suitable for use in treating small-weight fabric, small to medium-weight fabric and medium to heavy-weight fabric, respectively.

More specifically, in the operation state shown in FIG. 2, the main pump 6 is operated solely with the discharge-side flow-rate regulating valves 23 and 24 at the discharge side of the auxiliary pump circuit fully closed, while the suction-side flow-rate regulating valves 12,25,29 and 31 are kept opened to suitable opening degrees. By operating the apparatus in this condition, it is possible to effectively treat the light-weight fabric. (Refer to items of taffeta and paress in Table 1).

FIG. 7 shows an arrangement suitable for treating fabric of small to medium weight. According to this arrangement, the main pump 2 and the auxiliary pump 3 are driven by motors M1(5.5 KW) and M2(5.5 KW), respectively. The flow-rate regulating valves 12 and 24 are closed, while the flow-rate regulating valves 25,29 and 31 are opened so that the main pump and the auxiliary pump work in a tandem or series manner.

FIG. 8 shows an arrangement suitable for treating fabrics of medium to heavy weights. In this case, the main pump 2 and the auxiliary pump 3 are driven by motors M1 (5.5 KW) and M2 (5.5 KW), respectively. The flow-rate regulating valves 23 and 25 are kept closed, while flow-rate regulating valves 12,29,31 and 24 are kept opened so that the main pump and the auxiliary pump operate in a parallel manner (Refer to 2. crepe and 4. karsey does in Table 2).

The apparatus of the invention was experimentarily compared with conventional apparatus to obtain a result as shown in the following Table.

Result of Experimental Dyeing of Typical Polyester Fabrics

| | | | | apparatus of invention | | | | conventional apparatus | | |
|---|---|---|---|---|---|---|---|---|---|---|
| | | capacity | | main | aux' | | fabric | fabric | | |
| fabrics | weight g/m | roll | weight Kg | pump KW | pump KW | liquid amount | speed m/min | speed m/min | pump KW | liquid amount |
| 1 taffeta | 56 | 16 | 448 | 5.5 | | 700 | 380 | 250 | 15 | 800 |
| 2 crepe | 140 | 12 | 84 | 5.5 | 5.5 | 700 | 450 | 250 | 15 | 700 |
| 3 palace | 86 | 20 | 86 | 5.5 | | 600 | 300 | 150 | 15 | 700 |
| 4 kersey | 343 | 6 | 112.2 | 5.5 | 5.5 | 1,000 | 650 | 400 | 15 | 1,000 |

-continued

Result of Experimental Dyeing of Typical Polyester Fabrics

| | | | | apparatus of invention | | | | conventional apparatus | | |
|---|---|---|---|---|---|---|---|---|---|---|
| | | capacity | | main | aux' | | fabric | fabric | | |
| fabrics | weight g/m | roll | weight Kg | pump KW | pump KW | liquid amount | speed m/min | speed m/min | pump KW | liquid amount |
| does | | | | | | | | | | |

The palace 3 shown in Table 2 above, a fabric of high weight loss of 30%, tends to cause slippage, which is a kind of destruction of the woven structure. Conventionally, it has been impossible to produce palace of A-class when the treatment is conducted at a high speed of 150 m/min. or higher. According to the invention, however, an A-class fabric is obtained even when the fabric speed is increased to double of the above-mentioned speed. As will be seen from the statement of all other embodiments, the present invention permits a remarkable increase of the fabric speed which in turn offers about 20 to 40% reduction in the dyeing time.

As has been described, according to the invention, the transfer of the treated fabric can be made smoothly without using any reel by the action of the two liquid jetting portions. In addition, the insertion and pick-up of the fabric into and out of the treating cell can be made easily through attaching and detaching of the guide pipe at a level above the surface of the treating liquid. The apparatus of the invention can operate without fail at an extremely low bathing ratio and high fabric speed for all kinds and structures of fabrics which could be treated hitherto by the apparatus of the kind described. Since two pumps operate simultaneously, the fabric is fed and transferred smoothly even when one of the pumps becomes inoperative due to surging or the like because the other pump works safely, although in such a case the speed of transfer of the fabric may be decreased slightly. Furthermore, it is possible to obtain a good suction effect which serves to control good state of array of fabric in the fabric stagnant portion. Furthermore, the flow-rate regulating valves provided at the discharge side of the pumps are effective in suppressing the tendency of generation of cavitation in the pumps, so that the flow rate of the liquid and, hence, the speed of transfer of the fabric are stabilized advantageously. The adjustment of flow rate by by-pass flow-rate regulating valves is made much simpler or completely eliminated by the stabilization of the flow-rate and the fabric transfer speed.

According to the invention, it is possible to save electric power by operating only one pump, depending on the kind, structure and treating rate of the fabric. Concerning the operation, it is possible to effect a cushion start by means of two pumps at the start-up of running of the fabric, so that the stabilization of the fabric in the initial period of the operation is very much facilitated. The by-pass flow-rate regulating valves can effectively be controlled automatically.

It is to be noted also that the apparatus of the invention can be applied to all kinds and structures of the fabrics treated hithereto by the apparatus of this kind, simply by controlling the flow-rate regulating valves 20 and 21. During the circulation of the fabric, all portions of the fabric are covered by the treating liquid, and there is no slip of any mechanical part such as a reel. Therefore, according to the invention, it is possible to stabilize the running speed of the fabric and further to increase the running speed even when the treated fabric is a delicate one, so that it is possible to attain a higher efficiency and better result of dyeing and treatment.

Finally it is to be pointed out that, the peculiar arrangement of the liquid jetting portions 5 and 6 and the installation of the transfer pipe 7 at the lower stage of the stagnant cell below the level of the treating liquid make it possible to reduce the length of the fabric lifting ramp portion at the outlet of the stagnant cell, which in turn ensures a smooth and efficient transfer of the fabric.

What is claimed is:

1. A liquid-flow type fabric treating apparatus comprising:

an annular fabric transfer passage composed of a transfer pipe adapted to transfer a fabric to be treated in straight and linear form and a stagnant cell connected to said transfer pipe and adapted to transfer said fabric in a winding form;

a first treating liquid jetting portion provided at the upstream-side end of said transfer pipe;

a fabric lifting ramp portion provided at the outlet of said stagnant cell;

a second treating liquid jetting portion formed on the upper end of said ramp portion;

at least one treating liquid circulation pump adapted for forcibly supplying a treating liquid from said stagnant cell to said first and second treating liquid jetting portions and to circulate said treating liquid;

and an inlet/outlet for fabric formed at the upper end of said ramp portion and a fabric guide pipe detachably secured to said inlet/outlet, said fabric guide pipe constituting a part of said annular fabric treating passage; wherein, when said fabric guide pipe is detached, said fabric guide passage is cut and opened to communicate with said inlet/outlet whereas, when said fabric guide pipe is attached, said transfer passage is completed.

2. A liquid-flow type fabric treating apparatus comprising:

an endless fabric transfer passage comprising a transfer pipe which transfers a fabric to be treated in a straight linear form and a stagnant cell connected to said transfer pipe and adapted to transfer said fabric in a winding form;

a first treating liquid jetting portion provided at the upstream-side end of said transfer pipe;

a fabric lifting ramp portion extending from a position below a liquid surface to a position above said liquid surface and formed at an outlet portion of said stagnant cell;

a second treating liquid jetting portion formed at an upper end of said ramp portion;

at least one treating liquid circulation pump adapted to forcibly supply the treating liquid to said first and second treating liquid jetting portions and to circulate said treating liquid; and said first and said second treating liquid jetting portions are aimed substantially in a direction of movement of said fabric so as to direct the treating liquid substantially in said direction of movement of said fabric.

3. A liquid-flow type fabric treating apparatus comprising:

an endless fabric transfer passage composed of a transfer pipe adapted to transfer a fabric to be treated in a straight and linear form and a stagnant cell connected to said transfer pipe and adapted to transfer said fabric in a winding form;

a first treating liquid jetting portion provided at the upstream-side end of said transfer pipe;

a fabric lifting ramp portion formed at the outlet portion of said stagnant cell;

a second treating liquid jetting portion provided at the upper end of said ramp portion;

a main treating liquid circulation pump and an auxiliary treating liquid circulation pump adapted for forcibly supplying a treating liquid to said first and second liquid jetting portions and to circulate said treating liquid;

said treating liquid circulation pumps constitute a switchable treating liquid circulation circuit, in said circuit at least one of said pumps is used singly, or both of said pumps are used simultaneously, to circulate said treating liquid; and said first and said second treating liquid jetting portions are aimed substantially in a direction of movement of said fabric so as to direct the treating liquid substantially in said direction of movement of said fabric.

* * * * *